US006732958B2

(12) United States Patent
Norville et al.

(10) Patent No.: US 6,732,958 B2
(45) Date of Patent: May 11, 2004

(54) 360 DEGREE ROTATIONAL DIRECTIONAL NOZZLE FOR TRIGGER SPRAYERS

(75) Inventors: John M. Norville, Madison, WI (US); James B. Caldwell, Sherman Oaks, CA (US)

(73) Assignee: 360 Enterprises, Sherman Oaks, CA (US)

( * ) Notice: Subject to any disclaimer, the term of this patent is extended or adjusted under 35 U.S.C. 154(b) by 0 days.

(21) Appl. No.: 10/162,294

(22) Filed: Jun. 4, 2002

(65) Prior Publication Data

US 2002/0170988 A1 Nov. 21, 2002

Related U.S. Application Data

(63) Continuation-in-part of application No. 09/695,686, filed on Oct. 24, 2000, now Pat. No. 6,409,103.

(51) Int. Cl.[7] ..... B05B 1/30

(52) U.S. Cl. ..... 239/582.1; 239/587.1; 239/587.2; 239/587.3; 222/531; 222/528

(58) Field of Search ..... 222/320, 382, 222/372, 383.1, 321.1, 383.3, 567, 526, 527, 531, 528; 239/333, 582.1, 587.4, 587.3, 587.1, 587.2, 587.5, 587.6; 285/261

(56) References Cited

U.S. PATENT DOCUMENTS

| | | | | | |
|---|---|---|---|---|---|
| 923,277 | A | | 6/1909 | Klinger | |
| 982,661 | A | * | 1/1911 | Dickens | 222/387 |
| 1,087,006 | A | * | 2/1914 | Fitzsimons | 239/507 |
| 1,637,908 | A | * | 8/1927 | Lea | 285/87 |
| 1,832,724 | A | * | 11/1931 | Mueller | 239/539 |
| 2,573,904 | A | * | 11/1951 | Grossman | 239/460 |
| 2,647,796 | A | * | 8/1953 | Ziherl | 239/470 |
| 2,759,766 | A | | 8/1956 | Thomas | |
| 2,884,206 | A | | 4/1959 | Dukes | |
| 3,061,202 | A | | 10/1962 | Tyler | |
| 3,116,856 | A | * | 1/1964 | Prussin | 222/402.24 |
| 3,475,039 | A | * | 10/1969 | Ortloff | 285/45 |
| 4,035,004 | A | | 7/1977 | Hengesbach | |
| 4,453,650 | A | * | 6/1984 | Witte et al. | 222/43 |
| 4,800,913 | A | | 1/1989 | Nitzberg et al. | |
| 4,819,832 | A | | 4/1989 | Lawson | |
| 4,922,859 | A | | 5/1990 | Durell et al. | |
| 5,160,071 | A | | 11/1992 | Wright | |
| 5,507,534 | A | | 4/1996 | Reitenberger et al. | |
| 5,615,809 | A | * | 4/1997 | Feer et al. | 222/484 |
| 5,622,056 | A | | 4/1997 | Utter | |
| 5,662,268 | A | * | 9/1997 | Katzenberger | 239/33 |
| 5,667,146 | A | | 9/1997 | Pimental et al. | |
| 5,722,830 | A | | 3/1998 | Brandhorst et al. | |
| 5,775,595 | A | | 7/1998 | Knodel et al. | |
| 5,988,530 | A | * | 11/1999 | Rockefeller | 239/333 |
| 6,415,956 | B1 | * | 7/2002 | Havlovitz | 222/109 |
| 6,439,241 | B2 | * | 8/2002 | Berke et al. | 132/200 |
| 6,443,332 | B1 | | 9/2002 | Costea | |
| 6,592,057 | B1 | * | 7/2003 | Ericksen et al. | 239/587.1 |

FOREIGN PATENT DOCUMENTS

| | | |
|---|---|---|
| GB | 2230479 | 10/1990 |
| JP | 07-237678 | 9/1995 |
| JP | 2000-189857 | 7/2000 |

* cited by examiner

*Primary Examiner*—Gregory L. Huson
*Assistant Examiner*—Azy Kokabi
(74) *Attorney, Agent, or Firm*—The Maxham Firm

(57) ABSTRACT

A liquid dispensing device generally comprising an improved nozzle that is adaptable, connectable, threadable or integrally formed with a standard trigger spray head. The improved nozzle is also swivelable or rotatable and directional to spray in any direction, up or down, left or right, straight ahead, or any variation thereof. It also has a cap that can be turned to produce a stream, a spray or a foam, or any variation thereof. The nozzle may be manufactured either as an attachment to an existing trigger spray unit or as a pre-manufactured integral assembly.

7 Claims, 4 Drawing Sheets

360 DEGREE ROTATIONAL DIRECTIONAL NOZZLE FOR TRIGGER SPRAYERS

CROSS-REFERENCE TO RELATED APPLICATION

This application is a continuation-in-part of prior application Ser. No. 09/695,686, filed 24 Oct. 2000, which has issued as U.S. Pat. No. 6,409,103 on 25 Jun. 2002.

BACKGROUND OF THE INVENTION

1. Field of the Invention

The present invention relates generally to liquid dispensing devices and nozzles, and more particularly to a trigger type sprayer nozzle which is improved and adapted to spray in all directions.

2. Discussion of the Related Art

Generally, a trigger dispenser of the type involved here is a relatively low-cost pump device which is held in the hand and which has a trigger operable by squeezing or pulling the fingers of the hand to pump liquid from a container and through a nozzle at the front of the dispenser.

Such dispensers may have a variety of features that have become common and well known in the industry. For example, the dispenser may be a dedicated sprayer that produces a defined spray pattern for the liquid as it is dispensed from the nozzle. It is also known to provide adjustable spray patterns so that with a single dispenser the user may select any one of several emission patterns ranging from a stream to a fine mist.

Some known trigger dispensers also include a way to seal the dispenser to prevent liquid from leaking from the nozzle orifice during shipment or non-use. It is important to safely seal the container for shipping, product integrity, shelf display and many other safety issues. A variety of sealing arrangements are known. Such dispensers are generally referred to in the industry as "shippers." It is also well known to provide trigger dispensers with a means to produce foaming of the liquid as it is dispensed from the nozzle orifice. Such dispensers are generally referred to in the industry as "foamers." Various types of foamers are well known to those skilled in the art.

Many substances are currently sold and marketed in containers with trigger sprayers. Examples of such substances include carpet cleaners, spot removers, personal care products, cleaning products, weed control and pest control products, and materials for other general spraying uses. Typically, such items comprise a bottle that includes a spray head attached thereto. The spray head includes a manual pump that is actuated by the hand of a user to dispense the particular liquid product in a spray or stream or foam to a desired surface location or in a desired direction.

The fluid connection between the spray head and the bottle containing the liquid is usually facilitated by a feed tube that extends downwardly from the spray head and into the liquid. The feed tube is generally sized so as to extend to a location adjacent the bottom surface of the bottle so that the entire contents of the bottle may be dispersed via the spray head. In operation, the actuation of the manual pump by the user creates a suction in the feed tube thereby drawing liquid therethrough for subsequent dispersion via the spray head.

Such containers typically possess certain inherent deficiencies that detract from their overall utility. Foremost is the requirement that such spray heads be generally horizontally oriented in order to function properly. In this respect, since the feed tube extends downwardly into the liquid within the bottle, tilting the bottle can result in drawing air rather than liquid into the feed tube, thereby causing the unit to loose function. In addition, many of the known spray heads have a built-in check valve. This check valve usually consists of a ball used to check or stop the fluid from returning down the feed tube. However, when the spray head is tilted the check valve ball can simply roll out of position and the unit will fail to draw liquid. In addition, the inverted container dangerously tilts the liquid toward the user's hand and may leak through the vent holes or connection cap. Thus, current spray containers must be generally horizontally stabilized and numerous hand pumping actions are needed to refill the feed tube or to reposition the check valve. This causes frustration and improper discharging of liquid.

According to current construction, trigger sprayers are generally inoperable when used to apply a spray, stream or foam of liquid in any direction other than in a generally horizontal direction. This particular deficiency becomes more apparent as the liquid level in the bottle decreases. The deficiencies of these trigger sprayers are very apparent when the user attempts to direct the spray in an other than horizontal direction.

This inability to apply a spray, stream or foam creates significant difficulties when using such containers in specific applications such as spraying up under the leaves of plants, spraying pesticides up under cabinets, cleaning any horizontal surface such as ceilings, hoods or light fixtures, or reaching under cars, animals, among others.

In addition, many applications require spraying in a downward direction such as spotting weeds, cleaning carpets, upholstery, floors, or countertops, for example. One attempt to provide downward application of a spray is seen in U.S. Pat. No. 5,160,071 to Wright. It describes a spray bottle with a nozzle pointing in a downward direction. However, it is clear that this spray bottle is not suitable for spraying in any other direction. Many other applications require spraying left or right to some minor or major degrees of angle to reach the particular task at hand. Examples are reaching in ovens to spray all sides, or spraying all sides of a shower.

Furthermore, current trigger sprayers present a problem of reaching these particular spray applications by attempting to turn the user's hand in awkward positions. To hold a heavy liquid spray bottle vertically to spray in different directions can be awkward, and as stated above, the unit may be inoperable in some position the user finds to be necessary. In addition, the liquid may leak onto the user's hand or spill. In many prior devices, in order to dispense the liquid in a variety of directions, the whole sprayer unit has to be pointed in the desired direction. This often results in the user's hand being forced into uncomfortable positions, as well as the spray being interrupted by air occasionally entering the inlet tube. This is clearly an undesirable situation.

Accordingly, there has not previously been available a nozzle connected or formed integrally to a trigger sprayer that is rotatable and directional to enable the user to spray in any direction without tilting the bottle. There is no known nozzle designed to swivel or rotate or pivot through angles up to 360 degrees, creating the ability to aim the discharge pattern in any direction the operator chooses.

SUMMARY OF THE INVENTION

The present invention provides an apparatus for dispensing fluid in any desired direction from a fluid container. It includes a spray applicator in fluid connection with the fluid in the container and a nozzle assembly positioned downstream in fluid flow relation to the spray applicator. The nozzle assembly further has conduit having an inlet end, a discharge end and a fluid passage, wherein an axis extending through the inlet end is at an angle with respect to an axis extending through the discharge. Further, the inlet end of the conduit is integrally formed with the spray applicator. Fluid can be dispensed in any desired direction while the container can remain generally upright or horizontal.

The angle between the axis extending through the inlet end and the axis extending through the discharge end of the conduit is in the range of about 1 to 90 degrees with respect to one another while the fluid passage is open. In a preferred embodiment, this angle is at about 60 degrees. In an embodiment of the invention, the conduit can be folded out from its retracted position into an open position, which may be achieved when the fluid passage is straight. The conduit can then be folded to where the axis extending through the inlet end is at approximately 60 degrees with respect to the axis extending through the discharge end, which is a frequently desired angle.

An alternate embodiment of a spray nozzle according to the invention includes a conduit having an inlet end, a discharge end and a fluid passage, where an the inlet end and the discharge end are connected by a movable joint in the conduit. The movable joint has a receptacle and an elongated conduit that have complementary contact surfaces and a central fluid passage. In this embodiment the fluid can be dispensed in any desired direction by appropriately positioning the movable joint.

In preferred embodiments the nozzle has a spray cap on the discharge end of the conduit and it is adjustable thereon to provide infinite adjustment of spray pattern or to provide a stream, spray or foam, or any combination thereof The spray cap may be constructed according to configurations that are commonly known in the art.

Trigger sprayers attached to containers or bottles which include the nozzle assembly of this invention are able to spray in up, down, left, right, straight, or any directional variation thereof, without tilting the bottle and will not loose function when directed in such manner. In addition the folding closure greatly improves the shipability and safety issues relating to positively closing the fluid passage. For example, the folding closure reduces the space occupied by a single container, resulting in more economical storage and shipping. Additionally, since the fluid passage is closed, this prevents leakage from the discharge orifice. The folding nozzle is preferably tightly received within a design or contour so as to provide some resistance when opening and closing the nozzle. A tight, well-fitting relationship between the latter components assures against inadvertent opening of the nozzle and provides a degree of child resistance, in that the nozzle is tightly folded and closes both the fluid passage and discharge orifice. The nozzle assembly greatly improves the ability to use trigger sprayers for many different uses including, but not limited to, carpet sprays, lawn and garden uses, cleaning products, industrial uses, health and beauty, and pet care, among others.

BRIEF DESCRIPTION OF THE DRAWINGS

The above and other objects and advantages of the present invention will become apparent from the following detailed description, when read in conjunction with the accompanying drawing, wherein.

DETAILED DESCRIPTION OF THE PREFERRED EMBODIMENTS

The nozzle assembly of this invention provides a dispensing nozzle that is rotatable and directional or swivelable to enable the user to spray in any direction without tilting the bottle. The nozzle is designed to swivel or rotate through about 360 degrees, creating the ability to aim the discharge pattern in any direction the operator chooses. In addition, the spray control cap on the nozzle can be adjusted to produce a stream, spray or foam, or any variation thereof.

Figure 2:
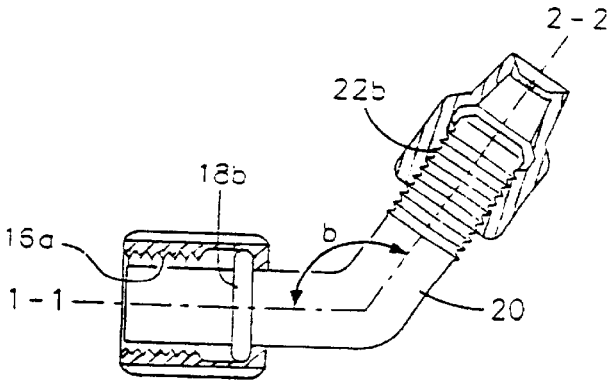
FIG. 2 is a side view illustrating the nozzle assembly shown in FIG. 1.

In one embodiment, longitudinal axes extending through the inlet end and the discharge end of the conduit are at approximately 60 degrees with respect to one another. However it is contemplated herein that this angle can be any practical angle between 1 and 90 degrees. These axes are shown in FIG. 2, where axis 1—1 extends longitudinally through the inlet end and axis 2—2 extends longitudinally through the discharge end. Angle b is the angle between axis 1—1 and axis 2—2.

Figure 1:
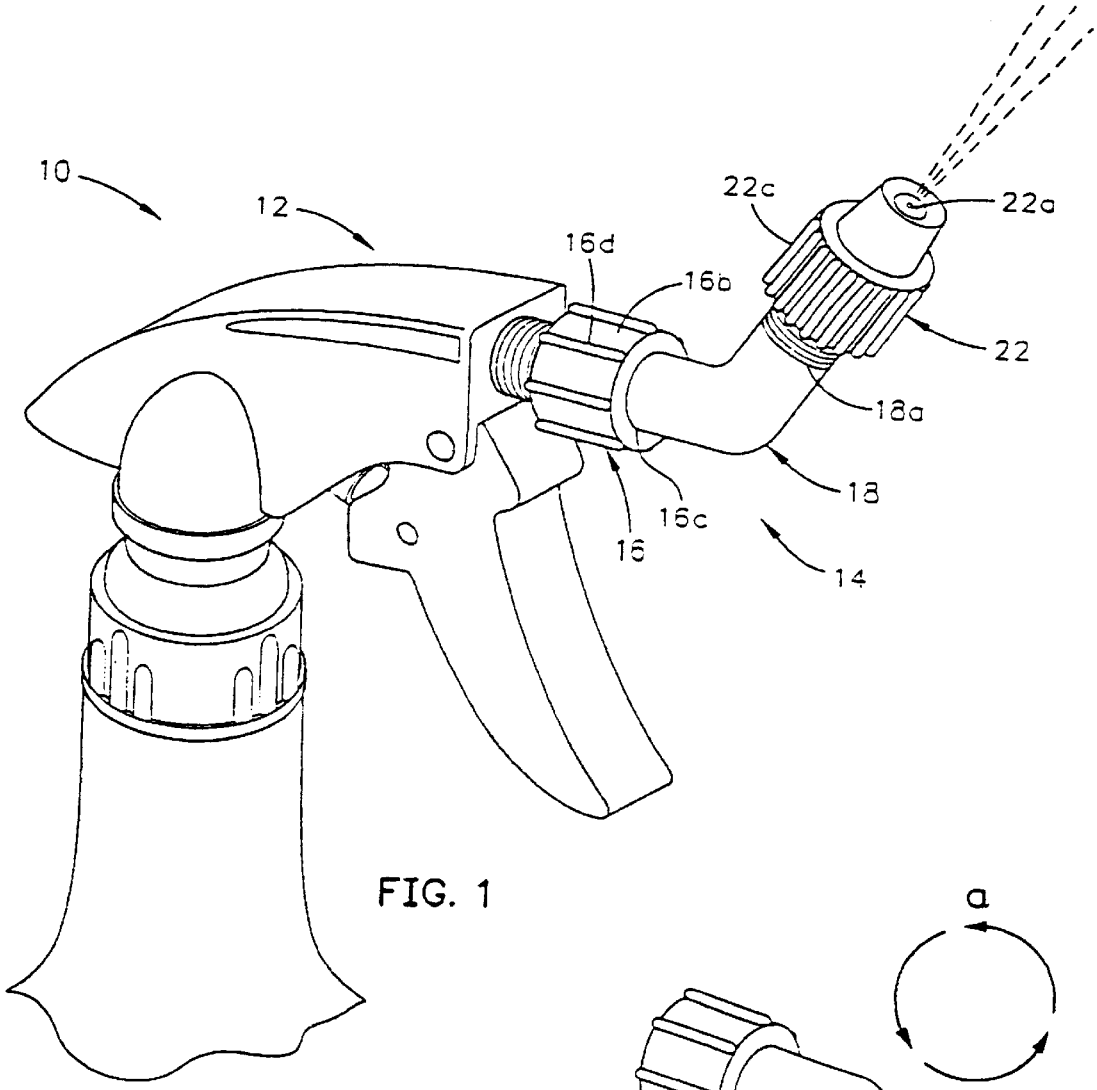
FIG. 1 is a perspective view of a rotational directional nozzle dispensing device attached to a trigger sprayer, the nozzle dispenser being constructed in accordance with a preferred embodiment of the present invention.

FIG. 1 illustrates nozzle assembly 14 threadably connected to trigger sprayer 10 constructed in accordance with an embodiment of the present invention. The trigger sprayer is shown coupled to a portion of the top of the bottle or container which holds the material to be sprayed. The nozzle assembly generally comprises connector 16 and rotatable conduit 18 with discharge end 20 configured to receive spray control cap 22.

Connector 16 preferably has receivable female threads 16*a* (FIG. 2). Connector outer wall 16*b* may be knurled at a point 16*d* therealong so it can be readily grasped and rotated. Additionally the connector has a receiving opening 16*c* to mate with the rotatable conduit 18. The rotatable conduit preferably has male threads 18*a* to receive spray control cap 22 on its discharge end 20. Cap 22 can be adjusted to provide a stream, a spray or a foam, or any variation thereof in a known manner, as desired. In addition, the spray control cap can be adjusted to provide a seal so that leakage of fluid is prevented during storage.

Rotatable conduit 18 also has flange 18*b* to hold the rotatable conduit in place within connector 16. The rotatable conduit is slidably inserted up to its flange in the receiving front portion of the body of trigger sprayer 10 to communicate with a fluid passage (not shown) in the trigger sprayer.

Connector 16 can be manually tightened to hold rotatable conduit 18 in position. Spray control cap 22 has outlet orifice 22*a* and female threaded receiver 22*b*. Also the spray control cap has outer wall 22*c* that may be knurled or otherwise designed for ease of handling. The knurling of cap 22 and connector 16 may be selected from the group consisting of ridges, indents and flutes of various shapes and sizes, as are commonly known in this art.

Figure 3:
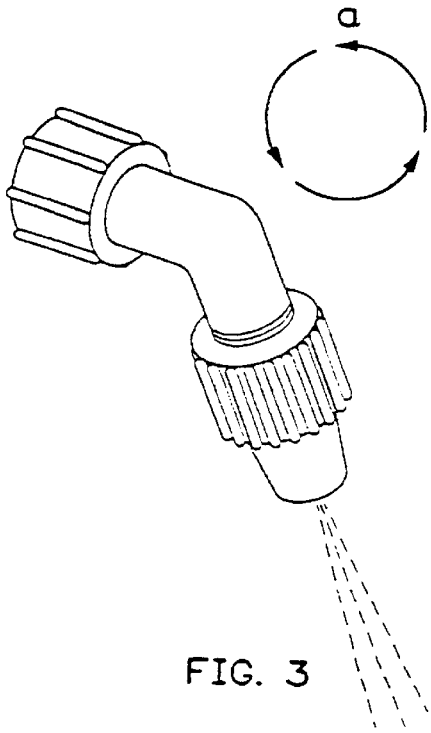
FIG. 3 is a perspective view of a rotational directional nozzle dispensing device constructed in accordance with a preferred embodiment of the present invention showing rotation "a" of the conduit.

The rotatable conduit is thereby mounted with the connector to the trigger sprayer allowing the conduit to freely rotate. This provides the ability to aim or direct the spray without changing the position of or without tilting the fluid container. This is advantageous because liquid can be conveniently delivered to almost any location while keeping the fluid container upright or horizontal. This ensures a continuous and reliable flow. Rotatable conduit flange 18*b* mounts comfortably into the fluid passage (not shown in the drawing) of trigger sprayer 10 and the flange can be tightened down with connector 16 in a permanent position or connector 16 may be slightly loosened to create the ability to easily rotate the conduit through 360 degrees, thereby creating directional moveability of the dispensed fluid. This rotation is shown, for example, in FIG. 3 by arrow "a." It will be recognized that spray control cap 22 may be selectively adjusted to apply a stream, a spray or a foam, as is conventional in the art.

Figure 4:
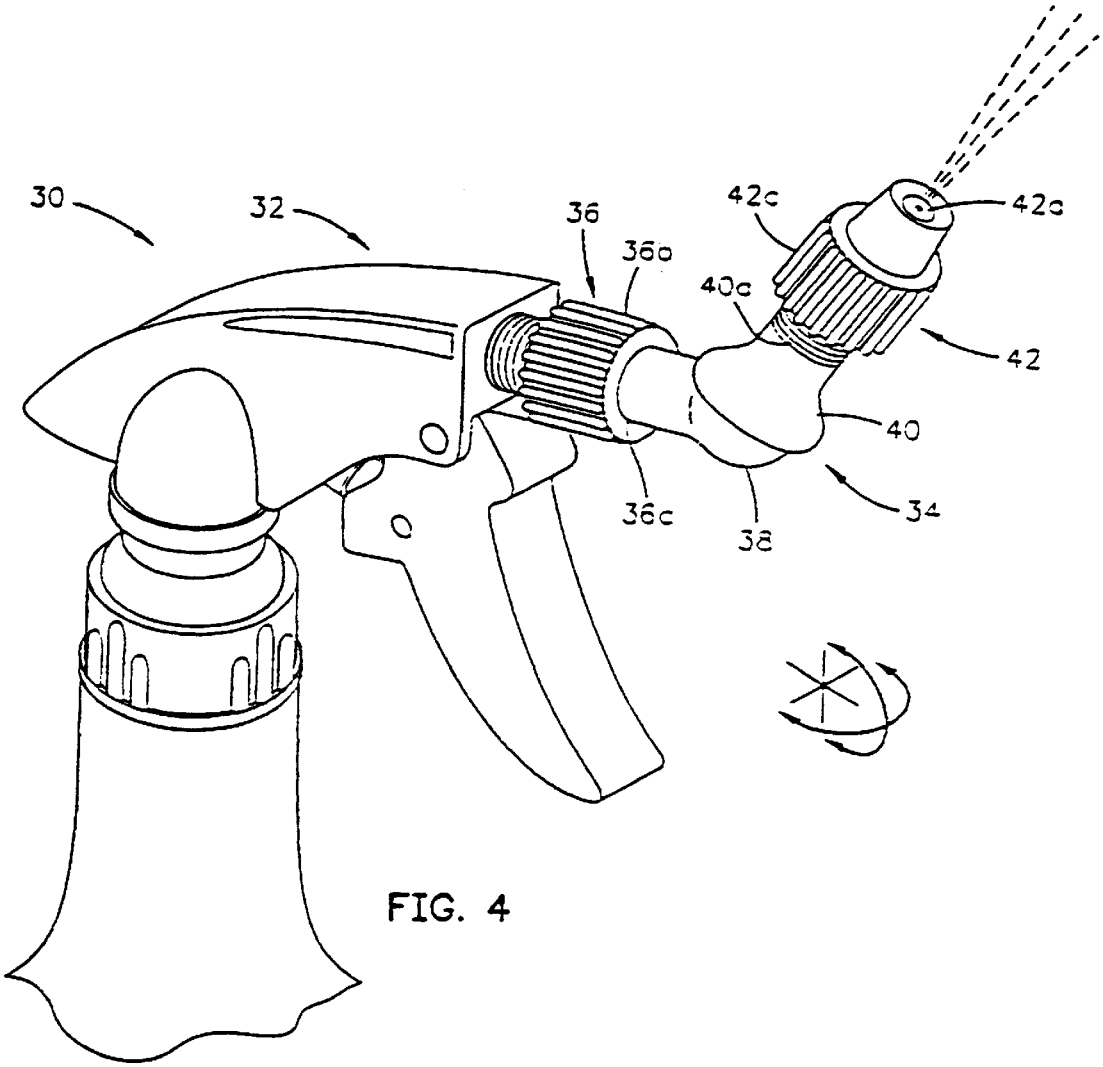
FIG. 4 is a perspective view illustrating a rotational directional nozzle dispensing device attached to a trigger sprayer, the nozzle dispenser being constructed in accordance with a second embodiment of the present invention.

Referring now to FIG. 4, there is shown a nozzle assembly 34 constructed in accordance with a second embodiment of the present invention. This nozzle assembly generally comprises a connector and rotational ball-joint-mount connectable member 36, rotatable ball joint member 38 which mates with receiving socket member 40 having discharge end 44 (see FIG. 5) that can receive spray control cap 42.

Figure 5:
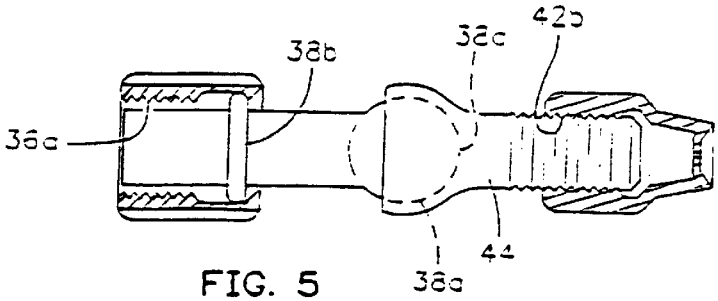
FIG. 5 is a side view illustrating the nozzle shown in FIG. 4.

Connector 36 preferably has female threads 36*a* (FIG. 5). Connector outer wall 36*b* may be knurled as shown so it can be readily grasped and rotated to tighten or loosen the mounting of connector 36 to trigger sprayer 32. Additionally, the connector has receiving opening 36*c* to mate with rotatable ball joint member 38, which is formed with flange 38*b*. This flange functions in the same manner as flange 18*b* in FIG. 2.

Figure 8:
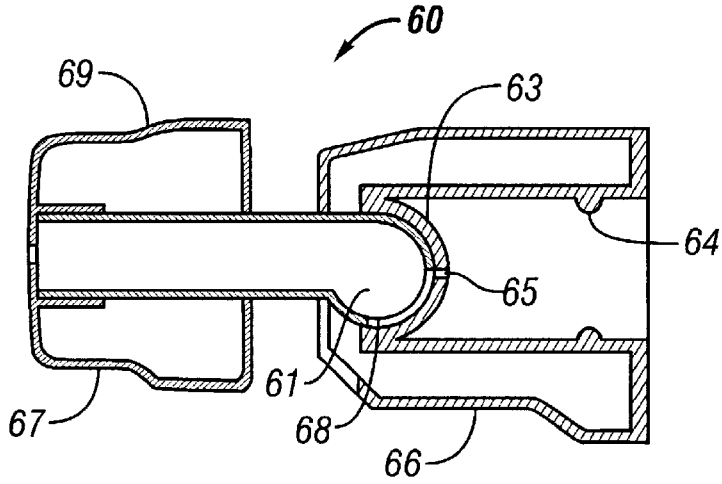
FIG. 8 is a sectional view of the nozzle dispensing device of FIG. 7.

Ball joint member 38 has rotatable ball element 38*a* at one end that is received within socket 38*c* of receiving socket member 40. The receiving socket member has male threads 40*a* to receive spray control cap 42 on discharge end 44 of socket member 40 or may be a snap fit connection, as shown in FIG. 8, for example. The spray control cap has outlet orifice 42*a* and female threaded receiver 42*b*. Examples of alternative ball joints are provided in U.S. Pat. No. 4,800,913 to Nitzberg et al. and U.S. Pat. No. 5,507,534 to Reifenberger et al. Other types of ball joints are contemplated herein, as are well known to those skilled in the art.

Spray control cap 42 has an outer wall 42*c* that may be knurled or otherwise designed for ease of handling. It is understood that the spray control cap may be selectively adjusted to apply a stream, a spray or a foam, as is conventional in the art. It is also understood that the spray cap may only produce a stream, a spray or a foam, or any variation thereof as may be desired. Additionally, in a preferred embodiment, the spray cap can be adjusted so that the container is sealed to prevent leakage during storage.

Figure 6:
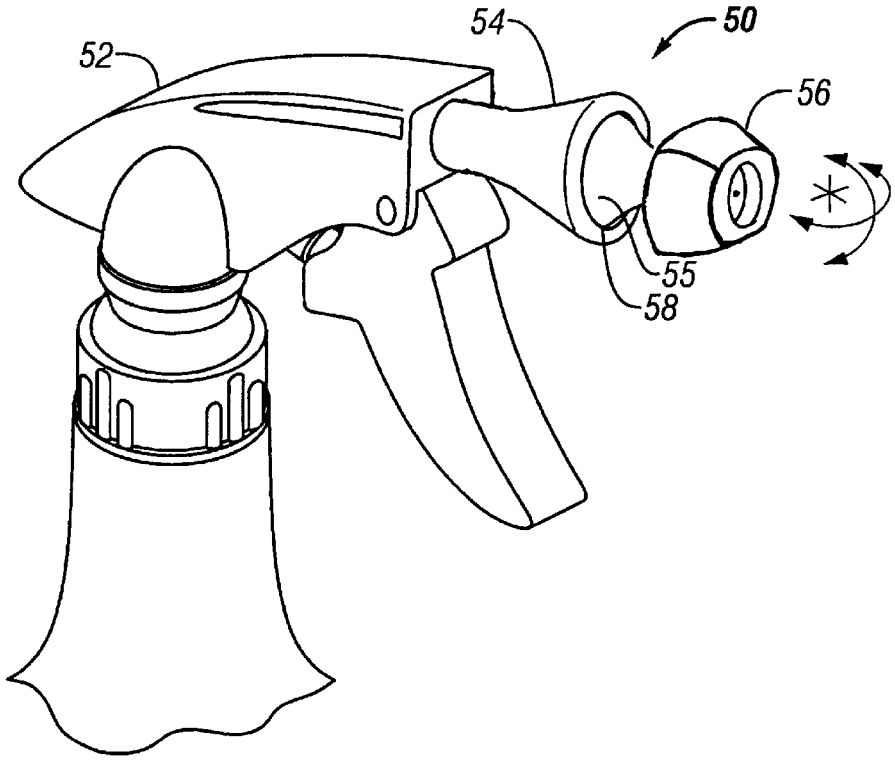
FIG. 6 is a perspective view of another embodiment of a rotational directional nozzle dispensing device employing a ball element and socket receiving member in accordance with the invention.

Another embodiment of the invention contemplated herein is shown in FIG. 6. Directional spray nozzle 50 comprises ball and socket joint 58, wherein receiving socket member 54 extends from trigger sprayer head 52. Ball element 55 has nozzle 56 on the distal end thereof. Although not shown in the drawing, if desired the ball element may extend from trigger sprayer 52 and socket member 54 will be reversed and will have nozzle 56 on the then distal end thereof. Rotation of the ball and socket is therefore provided so that the fluid may be sprayed in a variety of directions. In preferred embodiments, socket 54 (or ball 55) may be formed integrally with sprayer head 52. Additionally, if desired, the end of the nozzle may have a closure means, so that fluid leakage is prevented during transportation and storage. In the embodiment shown in FIG. 6, nozzle 56 can be rotated separately from ball element 55 to closed or open positions.

Figure 7:
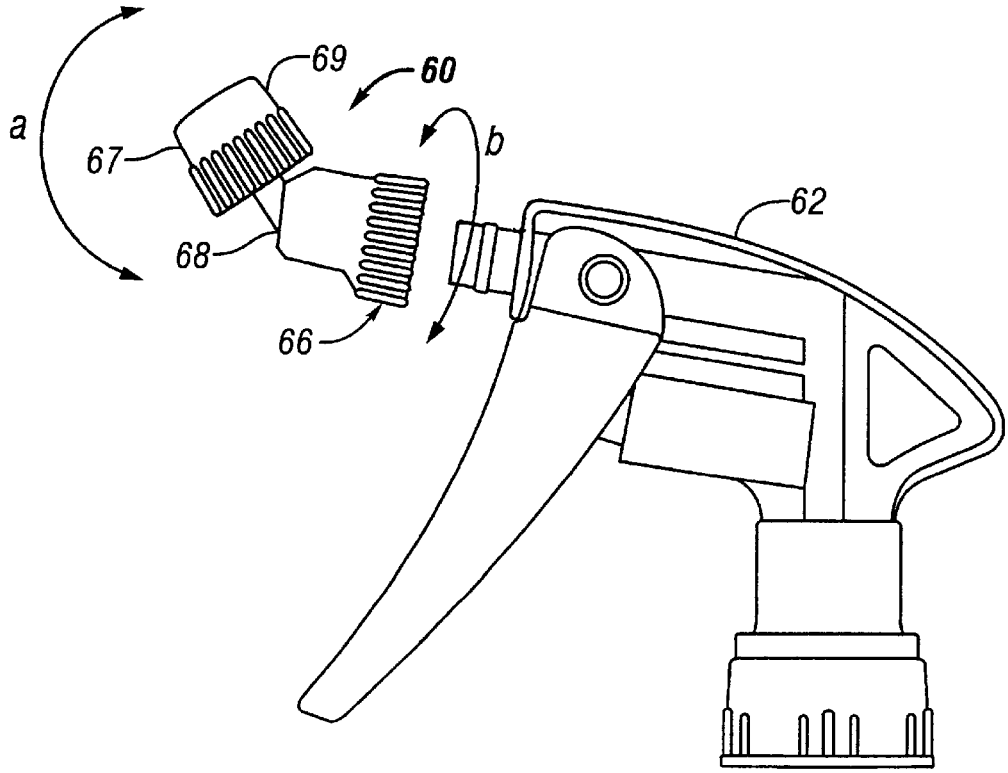
FIG. 7 is a side view of another embodiment of the invention showing a rotational directional nozzle dispensing device.

FIGS. 7 and 8 show yet another embodiment of the invention. Directional spray nozzle 60 is shown detached from trigger sprayer 62, but it can be easily attached by engagement with snap fit 64 (see FIG. 8) on the end of the trigger sprayer. Connector 66 and spray head 67 are disposed relative to one another by movable joint 68 which allows flexibility and movement of spray head 67 with respect to connector 66. As shown, spray head 67 is at an angle of approximately 60 degrees from horizontal in an upward direction. Spray head 67 generally comprises spray control cap 69 on its discharge end. Cap 69 can be adjusted to provide a stream, spray or foam or any variation thereof, as desired. In addition, the spray control cap can be adjusted to provide a seal so that leakage of fluid is prevented during storage. The outer surface or wall of cap 69 may also be knurled or otherwise designed for ease of turning.

Connector 66 is mounted to the trigger sprayer allowing it to freely rotate. This rotation is shown by arrow "b." Although FIG. 7 shows attachment of the connector by snap fit 64, other suitable connection means are also contemplated herein, for example, threads. However, a snap fit is preferred since it allows the assembly to rotate while maintaining a tight seal. In order to provide rotation with threads, the threads must be backed off, which increases the chance for fluid leakage. The configuration shown herein provides the ability to aim or direct the spray without changing the position or without tilting the fluid container. This is advantageous because liquid can be conveniently delivered to almost any location while keeping the container connected to the trigger sprayer horizontal.

Further sealing so that fluid leakage is prevented is provided by positioning spray head 67 into a closed position, as shown by arrow "a." In this orientation, spray head 67 is positioned in a downward direction, at approximately 90 degrees from horizontal. Fluid is prevented from exiting trigger sprayer 62 by the closing of the fluid passage.

In the embodiments disclosed herein, the device may be formed as a pre-manufactured assembly integrally formed with a trigger sprayer. As used herein, the term "pre-manufactured assembly" refers, for example, to components that are formed integrally that fit together as a cost-effective method of manufacturing. Accordingly, the trigger sprayer can be pre-manufactured with the connector therein at the fluid discharge point. For example, socket member 54 in FIG. 6 may be integrally formed with trigger sprayer 52 during the manufacturing process. In addition, connector 66 in FIG. 7 may be integrally formed with the trigger sprayer as well. Those skilled in the art would be able to determine based on marketability and economic factors, for example, whether having the assembly integrally formed is desirable or not.

FIG. 8 is a sectional side view of the nozzle dispensing device of FIG. 7 showing elongated conduit 61 and receptacle 63, with fluid passage 65 therein. In the configuration of the device shown, elongated conduit 61 is horizontal. In a preferred embodiment, snap ring 64 serves to provide a snap fit to the trigger sprayer head.

Figure 9A:
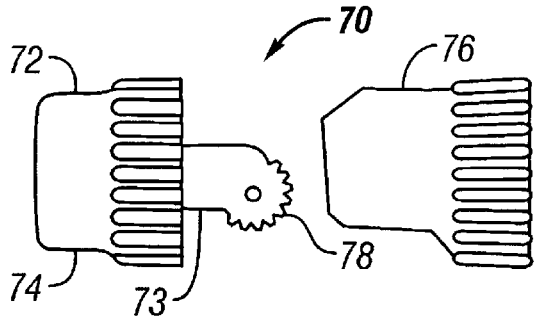
FIG. 9*a* is a side view illustrating a disassembled rotational directional nozzle dispensing device in accordance with the invention.
Figure 9B:
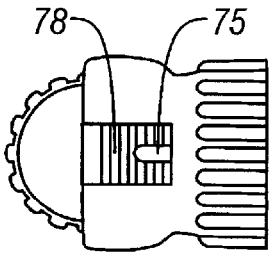
FIG. 9*b* is a top view of the nozzle dispensing device shown in FIG. 9*a* in an assembled state.

Referring now to FIGS. 9*a* and 9*b*, a view of the embodiment of directional nozzle assembly 70, shown in FIGS. 7 and 8, is shown in more detail. Elongated conduit 73 comprising part of spray head 72 and spray control cap 74 is shown extending in an upstream location. A receptacle (which is equivalent to elongated receptacle 63 in FIG. 8) is positioned in a corresponding orientation on connector 76. Elongated conduit 73 and the receptacle have complementary contact surfaces. One end of elongated conduit 73 is formed with a semicircular shape having ridges 78 that provide detented positioning to the device. Ridges 78 provide, in addition to stepwise positioning of the joint, tactile information about the movement and positioning of the device, which is a desirable commercial aspect. Corresponding grooves on the inside surface of the receptacle may also be provided if desired (not shown). Other securing means known in the art may be employed, for example, ridges, grooves, teeth, bumps or depressions.

As shown in FIG. 9*b*, the device is assembled and spray head 72 is positioned downwardly at approximately 90 degrees from horizontal which, in a preferred embodiment, is a closed position. Fluid passage 75 is shown exposed to the air. In this position the fluid passage does not communicate with the passage extending from the spray head. Accordingly, fluid cannot exit from the spray head and the fluid container is sealed.

The various forms of the invention described provide simply constructed and economical directional structures to provide a rotational and directional spray nozzle with the spray type being changeable or adjustable. Thus, the user of the present invention is able to spray in any direction desired without tilting the fluid container. This provides greater functionality by ensuring a continuous and reliable flow of fluid since the bottle can remain level throughout. In actual use the user frequently needs to be able to spray in multiple directions and this invention facilitates such directional dispensing.

It is understood by those skilled in the art that the rotatable conduit can have other shapes, such as elbows or angles of varying forms of degree, for example. The rotatable conduit may be manufactured to be in a permanent position of up or down or left or right, etc. The conduit may be manufactured as one piece with the connector or may be manufactured as one piece with the trigger sprayer. The housing may be constructed of a ball and receiving socket or a plurality of sockets and balls, such as described in U.S. Pat. No. 4,035,004 to Hengesbach. In addition, a shroud may cover the ball and socket. The shroud may be for designed for functional or aesthetic purposes. The connector is not limited to having threads or snap fits, but may be connected or adapted by other interconnection methods, such as quick-connect couplers, as are well known. Accordingly, it is contemplated herein that the connector comprises any suitable form of connection that allows a tight fit without leaking. A threaded connector is only one example.

The nozzle assembly may be manufactured from many different types of plastic or may be produced from other materials. It may be made of molded plastic at a relatively low cost. The nozzle assembly may be manufactured of bendable or flexible material to bend or rotate the conduit to direct the spray. In a preferred embodiment, the nozzle assembly can be bent or flexed and retained in that position. In addition, the spray control cap may be adapted to produce different types of spray, stream or foam. The nozzle assembly may be manufactured either as an attachment to an existing trigger spray unit or as a pre-manufactured assembly which is integrally formed with a trigger sprayer. As used herein, the term "pre-manufactured assembly" refers, for example, to components that are formed integrally that may result in a cost-effective method of manufacturing.

It is also understood to those skilled in the art that there are numerous manufacturers of trigger sprayers and in the preferred embodiment the nozzle assembly is threadably connected and the nozzle threads or connection may be designed to fit or adapt to many different styles of trigger sprayers. In another embodiment, a snap fit is preferred.

It is also understood that in another embodiment, the connection means are integrally formed with the trigger sprayer. Cost of manufacturing is dependent on whether the components are manufactured integrally or whether they are manufactured separate and later assembled.

While the present invention has been illustrated and described by means of a specific embodiment, it is to be understood that numerous changes and modifications can be made herein without departing from the intent and scope of the invention. Accordingly, the invention is limited only by the following claims.

What is claimed is:

1. A sprayer nozzle assembly for dispensing fluid in any direction chosen by a user from a container having a dispenser apparatus, the nozzle assembly comprising:

a conduit having an inlet end, a discharge end and a fluid passage, wherein said inlet end and said discharge end are connected by a movable joint in said conduit, and wherein said movable joint comprises a receptacle and an elongated conduit member having complementary contact surfaces;

said inlet end of the nozzle assembly being configured to rotatably mount on the dispenser, said discharge end being mounted to said inlet end and pivotable by about 90 degrees in one direction with respect to said inlet end, said complementary contact surfaces and said fluid passage being shaped and configured to permit fluid flow through said elongated conduit member through nearly 90 degrees, and closes the conduit when the relative angle between said inlet end and said discharge end reach a stop at about 90 degrees, said fluid being dispensed in any direction chosen by the user by rotating said inlet end with respect to the dispenser end and pivoting the discharge end with respect to the inlet end.

2. The device of claim 1, and further comprising a spray control cap on said discharge end of said conduit, said spray control cap being adjustable thereon to provide continuous adjustment of a discharge pattern on the fluid being dispensed.

3. The device of claims 2, wherein said spray control cap is knurled.

4. The nozzle assembly of claim 1, wherein said movable joint further comprises position securing means between said complementary contact surfaces.

5. The nozzle assembly of claim 4, wherein said position securing means are selected from the group consisting of ridges, grooves, teeth, bumps and depressions.

6. The device of claim 1, wherein said complementary contact surfaces are shaped and configured to permit pivoting of said elongated conduit member from linear alignment at about 0° to a right angle position at about 90 degrees.

7. The device of claim 6, wherein said inlet end is formed with a groove adjacent said contact surface of said receptacle, said elongated conduit member being pivotable within said groove.

* * * * *

UNITED STATES PATENT AND TRADEMARK OFFICE
Certificate

Patent No. 6,732,958 B2 Patented: May 11, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: John M. Norville, Madison, WI (US).

Signed and Sealed this Twenty-ninth Day of May 2007.

JUSTINE R. YU
*Supervisory Patent Examiner*
Art Unit 3771